US011320186B2

(12) United States Patent
Tomiyama

(10) Patent No.: US 11,320,186 B2
(45) Date of Patent: May 3, 2022

(54) HEAT PUMP WITH DEFROST TERMINATION BASED UPON SYSTEM TEMPERATURES

(71) Applicant: DAIKIN INDUSTRIES, LTD., Osaka (JP)

(72) Inventor: You Tomiyama, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 59 days.

(21) Appl. No.: 16/761,983

(22) PCT Filed: Nov. 2, 2018

(86) PCT No.: PCT/JP2018/040904
§ 371 (c)(1),
(2) Date: May 6, 2020

(87) PCT Pub. No.: WO2019/093249
PCT Pub. Date: May 16, 2019

(65) Prior Publication Data

US 2020/0355419 A1 Nov. 12, 2020

(30) Foreign Application Priority Data

Nov. 7, 2017 (JP) ..... JP2017-214905

(51) Int. Cl.
*F25B 47/02* (2006.01)
*F25B 13/00* (2006.01)
*F25B 49/02* (2006.01)

(52) U.S. Cl.
CPC ..... *F25B 47/025* (2013.01); *F25B 13/00* (2013.01); *F25B 49/02* (2013.01); *F25B 2347/02* (2013.01); *F25B 2700/2103* (2013.01)

(58) Field of Classification Search
CPC .. F25B 13/00; F25B 2700/2103; F25B 47/02; F25B 47/025; F25B 49/02
See application file for complete search history.

(56) References Cited

U.S. PATENT DOCUMENTS 5,931,009 A * 8/1999 Choi ..... F25D 21/006 62/154
2011/0113805 A1* 5/2011 Ko ..... F25B 47/025 62/234

(Continued)

FOREIGN PATENT DOCUMENTS

JP 63-201442 A 8/1988
JP 2007-232274 A 9/2007

OTHER PUBLICATIONS

International Search Report (PCT/ISA/210) issued in PCT/JP2018/040904, dated Feb. 5, 2019.

(Continued)

*Primary Examiner* — Henry T Crenshaw
(74) *Attorney, Agent, or Firm* — Birch, Stewart, Kolasch & Birch, LLP

(57) ABSTRACT

A refrigerant cycle apparatus is configured to suppress extension of defrost time. The refrigerant cycle apparatus includes: a refrigerant circuit; a first temperature sensor configured to measure first refrigerant temperature between the main heat exchange unit and the pressure loss portion; a second temperature sensor configured to measure second refrigerant temperature between the pressure loss portion and the expansion mechanism; and a controller configured to control the flow direction switching mechanism to switch between normal operation and defrost operation. The controller has control modes for the defrost operation, including a control mode of terminating the defrost operation based on the first refrigerant temperature and a control mode of terminating the defrost operation based on the second refrigerant temperature.

8 Claims, 4 Drawing Sheets

(56) References Cited

U.S. PATENT DOCUMENTS

| | | | | |
|---|---|---|---|---|
| 2013/0145785 | A1* | 6/2013 | Nobuhiro | F25B 13/00 62/160 |
| 2014/0090406 | A1* | 4/2014 | Ishikawa | F24F 11/30 62/82 |
| 2015/0040593 | A1* | 2/2015 | Ariga | F25B 29/003 62/156 |
| 2020/0355419 | A1* | 11/2020 | Tomiyama | F25B 6/04 |

OTHER PUBLICATIONS

Extended European Search Report for European Application No. 18875034.3, dated Nov. 25, 2020.

* cited by examiner

HEAT PUMP WITH DEFROST TERMINATION BASED UPON SYSTEM TEMPERATURES

TECHNICAL FIELD

The present disclosure relates to a refrigerant cycle apparatus, and particularly to a refrigerant cycle apparatus configured to execute defrost operation of causing a refrigerant to flow in a direction opposite to a direction during normal operation, for removal of frost adhering to a heat exchange unit during the normal operation.

BACKGROUND ART

There has been conventionally known a refrigerant cycle apparatus configured to execute defrost operation of causing a refrigerant to flow in a heat exchange unit, so as to cause the heat exchange unit to serve as a refrigerant cooler (radiator), in a direction opposite to a direction during normal operation, for removal of frost adhering to the heat exchange unit which serves as a refrigerant heater (heat absorber) during the normal operation.

Patent Literature 1 (JP S63-201442 A) discloses a refrigerant cycle apparatus configured to measure temperature of a refrigerant downstream of a heat exchange unit as a defrosting target during defrost operation (herein, the temperature of the refrigerant downstream of the heat exchange unit in a refrigerant flow direction during the defrost operation will be simply called downstream refrigerant temperature for simple description), and determine completion of defrosting based on the downstream refrigerant temperature.

SUMMARY OF THE INVENTION

Technical Problem

Such a heat exchange unit may include a main heat exchange unit, a sub heat exchange unit, and a pressure loss portion disposed on a refrigerant flow path between the main heat exchange unit and the sub heat exchange unit, and may be configured to cause a refrigerant to flow in an order of the sub heat exchange unit, the pressure loss portion, and the main heat exchange unit during normal operation and cause the refrigerant to flow in a direction opposite to the direction of the normal operation during defrost operation.

In the heat exchange unit thus configured, the sub heat exchange unit is disposed upstream of the pressure loss portion causing a pressure drop of the refrigerant in a refrigerant flow direction during the normal operation. The refrigerant flowing in the sub heat exchange unit is thus higher in temperature than the refrigerant flowing in the main heat exchange unit during the normal operation. Even when the heat exchange unit functions as a refrigerant heater, the sub heat exchange unit is less likely to have problematic frost. For example, even when the main heat exchange unit is desired to be defrosted, the sub heat exchange unit may not particularly need defrosting in some cases.

If the defrost operation is terminated based on the downstream refrigerant temperature as described above, the downstream refrigerant temperature increases based on temperature increase of the entire heat exchange unit. Therefore, even when the sub heat exchange unit does not need defrosting, the defrost operation may not be terminated until the temperature of the entire heat exchange unit including the sub heat exchange unit rises and the defrost operation may be unnecessarily prolonged.

It is an object of the present disclosure to provide a refrigerant cycle apparatus configured to execute defrost operation of causing a refrigerant to flow in a direction opposite to a direction during normal operation during which the refrigerant flows a sub heat exchange unit, a pressure loss portion, and a main heat exchange unit in this order, for inhibition of unnecessary extension of defrost time.

Solutions to Problem

A refrigerant cycle apparatus includes a refrigerant circuit, a first refrigerant temperature sensor, a second refrigerant temperature sensor, and an operation controller. The refrigerant circuit includes a compressor, a first heat exchange unit, a second heat exchange unit, an expansion mechanism, and a flow direction switching mechanism. The compressor compresses a refrigerant. The first heat exchange unit includes a main heat exchange unit, a sub heat exchange unit, and a pressure loss portion disposed on a refrigerant flow path between the main heat exchange unit and the sub heat exchange unit. The expansion mechanism is disposed on the refrigerant flow path between the first heat exchange unit and the second heat exchange unit, and decompresses the refrigerant. The flow direction switching mechanism switches a flow direction of the refrigerant discharged from the compressor, between a first flow direction and a second flow direction. The refrigerant flowing in the first flow direction flows to the second heat exchange unit, the expansion mechanism, the sub heat exchange unit, the pressure loss portion, and the main heat exchange unit in the mentioned order. The refrigerant flowing in the second flow direction flows in a direction opposite to the first flow direction. Specifically, the refrigerant flowing in the second flow direction flows to the main heat exchange unit, the pressure loss portion, the sub heat exchange unit, the expansion mechanism, and the second heat exchange unit in the mentioned order. The first refrigerant temperature sensor measures temperature, as first refrigerant temperature, of the refrigerant flowing in the main heat exchange unit or between the main heat exchange unit and the pressure loss portion. The second refrigerant temperature sensor measures temperature, as second refrigerant temperature, of the refrigerant flowing between the pressure loss portion and the expansion mechanism. The operation controller controls the flow direction switching mechanism to switch between normal operation of causing the refrigerant to flow in the first flow direction and defrost operation of causing the refrigerant to flow in the second flow direction. The operation controller has control modes for the defrost operation, including at least a first defrost control mode and a second defrost control mode. In the first defrost control mode, the operation controller terminates the defrost operation based on the first refrigerant temperature. In the second defrost control mode, the operation controller terminates the defrost operation based on the second refrigerant temperature.

The present refrigerant cycle apparatus operating in the first defrost control mode is configured to terminate the defrost operation based on a defrosting status at the main heat exchange unit, to suppress extension of defrost time when the sub heat exchange unit does not particularly need defrosting.

Preferably, the operation controller in the refrigerant cycle apparatus executes the defrost operation in the first defrost control mode when the second refrigerant temperature measured before the defrost operation starts is equal to or more than first temperature.

In this case, the defrost operation in the first defrost control mode is executed when the second refrigerant temperature before the defrost operation starts is relatively high. This configuration suppresses unnecessary extension of the defrost time when the sub heat exchange unit does not particularly need defrosting.

More preferably, the operation controller in the refrigerant cycle apparatus executes the defrost operation in the first defrost control mode when the second refrigerant temperature measured during the normal operation before the defrost operation starts is equal to or more than the first temperature.

In this case, the defrost operation is executed in the first defrost control mode when the sub heat exchange unit is less likely to have frost or frost on the sub heat exchange unit is likely to melt during the normal operation. This configuration suppresses unnecessary extension of the defrost time when the sub heat exchange unit does not particularly need defrosting.

Preferably, the operation controller in the refrigerant cycle apparatus executes the defrost operation in the second defrost control mode when the measured second refrigerant temperature is less than the first temperature.

This configuration is likely to suppress frost from remaining unmelted at the heat exchange unit including the sub heat exchange unit.

Preferably, the refrigerant cycle apparatus further includes an air temperature sensor. The air temperature sensor measures air temperature around the first heat exchange unit. The operation controller executes the defrost operation in the first defrost control mode when the air temperature is equal to or more than second temperature.

In this case, the defrost operation is executed in the first defrost control mode when the air temperature around the first heat exchange unit is relatively high and the sub heat exchange unit is less likely to have frost or frost on the sub heat exchange unit is likely to melt. This configuration is therefore likely to suppress unnecessary extension of the defrost time.

More preferably, the operation controller in the refrigerant cycle apparatus executes the defrost operation in the second defrost control mode when the air temperature is less than the second temperature.

This configuration is likely to suppress frost from remaining unmelted at the heat exchange unit including the sub heat exchange unit even when the air temperature around the first heat exchange unit is relatively low.

The pressure loss portion in the refrigerant cycle apparatus is preferably a branching portion of the refrigerant flow path in the first flow direction.

DESCRIPTION OF EMBODIMENTS

A refrigerant cycle apparatus according to an embodiment of the present disclosure will be described hereinafter with reference to the drawings.

(1) Overall Configuration

Figure 1:
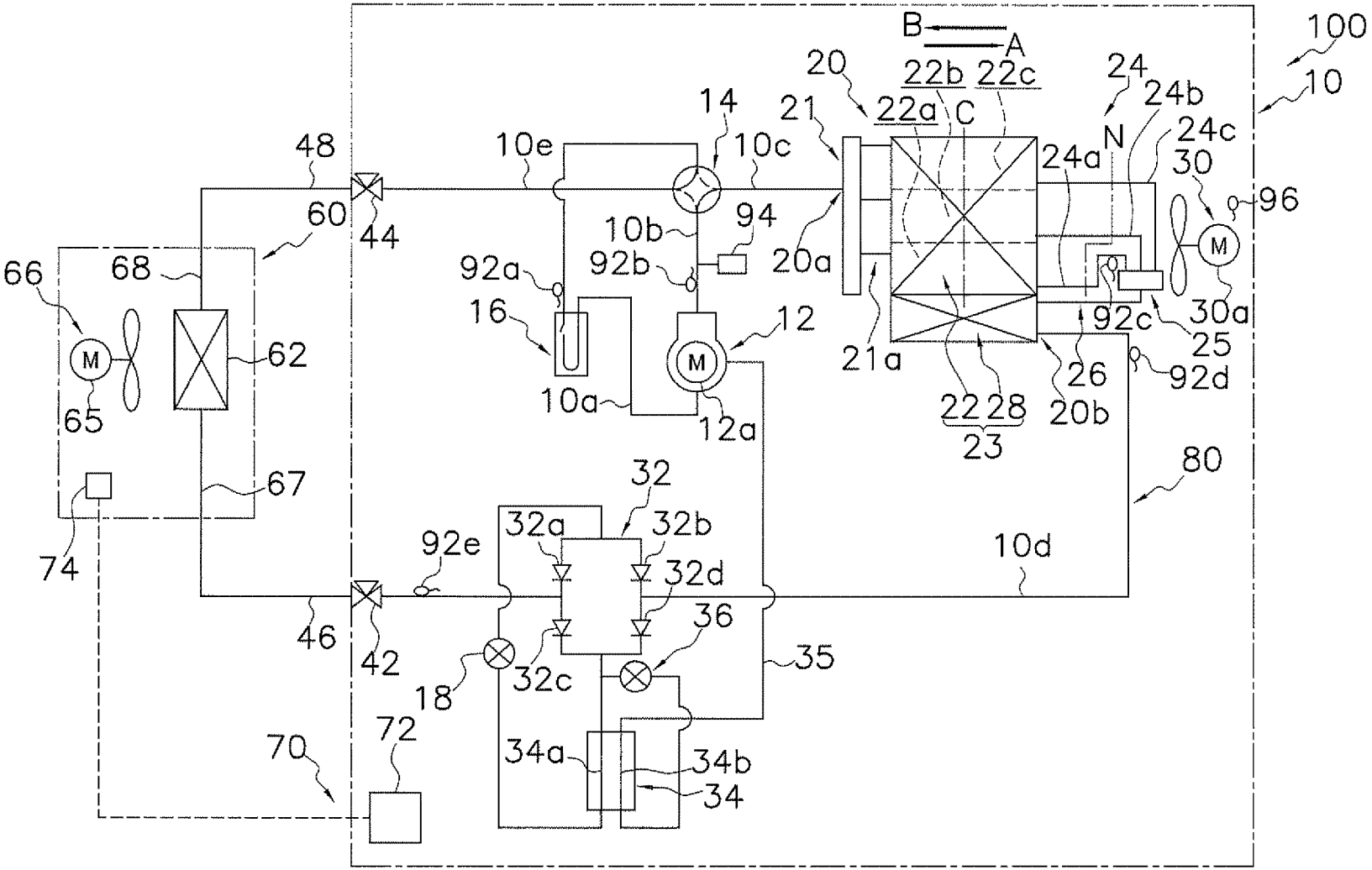
FIG. 1 is a schematic configuration diagram of a refrigerant cycle apparatus according to an embodiment of the present disclosure.

FIG. 1 is a schematic configuration diagram of a refrigerant cycle apparatus 100 according to a practical example.

The refrigerant cycle apparatus 100 herein is an air conditioner configured to cool or heat an interior of a building by means of a vapor compression refrigeration cycle. The refrigerant cycle apparatus 100 should not be limited to the air conditioner, but may alternatively be configured as a different apparatus such as a hot water supply apparatus.

The refrigerant cycle apparatus 100 principally includes a heat source unit 10, a utilization unit 60, a liquid-refrigerant connection pipe 46, and a gas-refrigerant connection pipe 48 (see FIG. 1). The liquid-refrigerant connection pipe 46 and the gas-refrigerant connection pipe 48 connect the heat source unit 10 and the utilization unit 60. The liquid-refrigerant connection pipe 46 and the gas-refrigerant connection pipe 48 are constructed onsite when the refrigerant cycle apparatus 100 is installed.

The refrigerant cycle apparatus 100 according to the present embodiment includes the single utilization unit 60, but may alternatively include a plurality of utilization units 60 connected in parallel.

The heat source unit 10 and the utilization unit 60 are connected via the liquid-refrigerant connection pipe 46 and the gas-refrigerant connection pipe 48 to constitute a refrigerant circuit 80. The refrigerant circuit 80 principally includes a compressor 12, a heat source heat exchanger 20, an expansion mechanism 18, and a flow direction switching mechanism 14 included in the heat source unit 10, and a utilization heat exchanger 62 included in the utilization unit 60.

Although it is not limited, a refrigerant adopted in the refrigerant cycle apparatus 100 may be a fluorocarbon refrigerant such as R32. The refrigerant adopted in the refrigerant cycle apparatus 100 may alternatively be a natural refrigerant.

The refrigerant cycle apparatus 100 is configured to execute cooling operation, heating operation, and defrost operation. The cooling operation is executed to cool air in an air conditioning target space provided with the utilization unit 60. The heating operation is executed to heat air in the air conditioning target space provided with the utilization unit 60.

The defrost operation is executed to achieve a principal object of removing frost formed on the heat source heat exchanger 20.

(2) Detailed Configurations

(2-1) Utilization Unit

The utilization unit 60 is installed in the air conditioning target space such as an interior of a building.

The utilization unit 60 may be of a ceiling embedded type to be installed in a ceiling. The utilization unit 60 should not be limited to the ceiling embedded type, but may alternatively be of a ceiling pendant type, a wall mounted type to be mounted on a wall, a floor mount type to be placed on a floor, or the like.

As described above, the utilization unit 60 is connected to the heat source unit 10 via the liquid-refrigerant connection pipe 46 and the gas-refrigerant connection pipe 48, and constitutes part of the refrigerant circuit 80.

The utilization unit 60 will be described below in terms of its configuration.

The utilization unit 60 principally includes the utilization heat exchanger 62, a utilization fan 66, and a utilization control unit 74 (see FIG. 1). The utilization unit 60 further includes a liquid refrigerant pipe 67 connecting a liquid side of the utilization heat exchanger 62 and the liquid-refrigerant connection pipe 46, and a gas refrigerant pipe 68 connecting a gas side of the utilization heat exchanger 62 and the gas-refrigerant connection pipe 48 (see FIG. 1).

The utilization heat exchanger 62 exemplifies the second heat exchange unit. The utilization heat exchanger 62 should not be limited in terms of its type, but may be exemplified by a fin-and-tube heat exchanger of a cross-fin type including heat transfer tubes (not depicted) and a large number of fins (not depicted). The utilization heat exchanger 62 causes heat exchange between the refrigerant flowing in the utilization heat exchanger 62 and indoor air (air in the air conditioning target space). The utilization heat exchanger 62 has a liquid side end connected to the liquid refrigerant pipe 67, and a gas side end connected to the gas refrigerant pipe 68.

During cooling operation, the utilization heat exchanger 62 functions as a refrigerant heater (evaporator) configured to heat a refrigerant flowing from the heat source heat exchanger 20 functioning as a refrigerant cooler (condenser) via the expansion mechanism 18. During heating operation, the utilization heat exchanger 62 functions as a refrigerant cooler (condenser) configured to cool a refrigerant compressed by the compressor 12.

The utilization fan 66 is configured to suck indoor air into the utilization unit 60, supply the sucked indoor air to the utilization heat exchanger 62, and supply air that exchanged heat with a refrigerant in the utilization heat exchanger 62 to the indoor. The utilization fan 66 is exemplified by a centrifugal fan such as a turbo fan or a sirocco fan. The utilization fan 66 should not be limited to the centrifugal fan in terms of its type, but may be configured appropriately. The utilization fan 66 is driven by a fan motor 65.

The utilization control unit 74 controls operation of respective parts of the utilization unit 60. The utilization control unit 74 includes a microcomputer, a memory, and the like provided for control of the utilization unit 60. The utilization control unit 74 is configured to transmit and receive control signals and the like to and from the heat source unit 10 via a communication line. The utilization control unit 74 is further configured to receive signals relevant to operation and stop of the refrigerant cycle apparatus 100 and signals relevant to various setting, and the like transmitted from a remote controller (not depicted) provided for operation of the utilization unit 60.

The utilization unit 60 includes various sensors. For example, the utilization unit 60 includes an indoor temperature sensor (not depicted) configured to measure temperature of indoor air sucked into the utilization unit 60.

(2-2) Heat Source Unit

The heat source unit 10 is exemplarily placed outside a building provided with the refrigerant cycle apparatus 100.

As described above, the heat source unit 10 is connected to the utilization unit 60 via the liquid-refrigerant connection pipe 46 and the gas-refrigerant connection pipe 48, and constitutes part of the refrigerant circuit 80.

The heat source unit 10 will be described below in terms of its configuration.

The heat source unit 10 principally includes the compressor 12, the flow direction switching mechanism 14, the heat source heat exchanger 20, the expansion mechanism 18, an accumulator 16, a bridge circuit 32, an economiser heat exchanger 34, an injection valve 36, and a heat source fan 30 (see FIG. 1). The heat source unit 10 further includes various sensors. The heat source unit 10 still further includes a heat source control unit 72 configured to control operation of respective parts of the heat source unit 10 (see FIG. 1).

The heat source unit 10 also includes a suction pipe 10*a*, a discharge pipe 10*b*, a first gas refrigerant pipe 10*c*, a liquid refrigerant pipe 10*d*, and a second gas refrigerant pipe 10*e* (see FIG. 1). The suction pipe 10*a* connects the flow direction switching mechanism 14 and a suction side of the compressor 12. The discharge pipe 10*b* connects a discharge side of the compressor 12 and the flow direction switching mechanism 14. The first gas refrigerant pipe 10*c* connects the flow direction switching mechanism 14 and a gas side end of the heat source heat exchanger 20. The liquid refrigerant pipe 10*d* connects a liquid side end of the heat source heat exchanger 20 and the liquid-refrigerant connection pipe 46. A liquid-side shutoff valve 42 is disposed at a part at which the liquid refrigerant pipe 10*d* and the liquid-refrigerant connection pipe 46 are connected. The second gas refrigerant pipe 10*e* connects the flow direction switching mechanism 14 and the gas-refrigerant connection pipe 48. A gas-side shutoff valve 44 is disposed at a part at which the second gas refrigerant pipe 10*e* and the gas-refrigerant connection pipe 48 are connected. The liquid-side shutoff valve 42 and the gas-side shutoff valve 44 are configured to be manually opened and closed.

The heat source unit 10 will be described below in terms of its various parts.

(2-2-1) Compressor

The compressor 12 is configured to compress a refrigerant. The compressor 12 pressurizes a low-pressure refrigerant to reach high pressure.

The compressor 12 is configured as a displacement compressor of a rotary type or a scroll type, though not limited in terms of its type. The compressor 12 includes a compression mechanism (not depicted) driven by a compressor motor 12*a* (see FIG. 1). The compressor motor 12*a* is configured to have a number of rotations controlled by an inverter or the like. The number of rotations of the compressor motor 12*a* is controlled to control the capacity of the compressor 12. The compression mechanism of the compressor 12 may alternatively be driven by a motor (e.g. an internal combustion engine) other than the electric motor.

(2-2-2) Switching Mechanism

The flow direction switching mechanism 14 is configured to switch a flow direction of the refrigerant in the refrigerant circuit 80. The flow direction switching mechanism 14 is configured to switch the flow direction of the refrigerant discharged from the compressor 12, between a first flow direction and a second flow direction (the first flow direction and the second flow direction will be described later). The flow direction switching mechanism 14 herein is configured as a four-way switching valve.

The flow direction switching mechanism 14 switches the flow direction of the refrigerant discharged from the compressor 12 to the first flow direction during heating operation exemplifying normal operation. When the refrigerant flow direction is switched to the first flow direction, the refrigerant discharged from the compressor 12 flows, in the refrigerant circuit 80, through the utilization heat exchanger 62, the expansion mechanism 18, and the heat source heat exchanger 20 in the mentioned order. More specifically, when the refrigerant flow direction is switched to the first flow direction, the refrigerant discharged from the compressor 12 flows, in the refrigerant circuit 80, through the utilization heat exchanger 62, the expansion mechanism 18, a sub heat exchange unit 28 of the heat source heat exchanger 20, a distributor 25 of the heat source heat exchanger 20, and a main heat exchange unit 22 of the heat source heat exchanger 20 in the mentioned order (the heat source heat exchanger 20 will be described later).

The flow direction switching mechanism 14 causes pipes to be connected in the following manner when the refrigerant flow direction is set to the first flow direction (herein, mentioned as while the first flow direction is selected). While the first flow direction is selected, the flow direction switching mechanism 14 causes the suction pipe 10*a* to communicate with the first gas refrigerant pipe 10*c*, and causes the discharge pipe 10*b* to communicate with the second gas refrigerant pipe 10*e* (see broken lines in the flow direction switching mechanism 14 depicted in FIG. 1). Specifically, while the first flow direction is selected, the flow direction switching mechanism 14 causes the suction side of the compressor 12 to communicate with the gas side end of the heat source heat exchanger 20 via the suction pipe 10*a* and the first gas refrigerant pipe 10*c*, and causes the discharge side of the compressor 12 to communicate with the gas-refrigerant connection pipe 48 via the discharge pipe 10*b* and the second gas refrigerant pipe 10*e*. When the flow direction switching mechanism 14 achieves connection of the pipes in this state, the refrigerant circuit 80 comes into a heating operation state. While the first flow direction is selected, the heat source heat exchanger 20 functions as a refrigerant heater (evaporator) and the utilization heat exchanger 62 functions as a refrigerant cooler (condenser).

The flow direction switching mechanism 14 switches the flow direction of the refrigerant discharged from the compressor 12 to the second flow direction during cooling operation and defrost operation. When the refrigerant flow direction is switched to the second flow direction, the refrigerant discharged from the compressor 12 flows, in the refrigerant circuit 80, through the heat source heat exchanger 20, the expansion mechanism 18, and the utilization heat exchanger 62 in the mentioned order. More specifically, when the refrigerant flow direction is switched to the second flow direction, the refrigerant discharged from the compressor 12 flows, in the refrigerant circuit 80, through the main heat exchange unit 22 of the heat source heat exchanger 20, the distributor 25 of the heat source heat exchanger 20, the sub heat exchange unit 28 of the heat source heat exchanger 20, the expansion mechanism 18, and the utilization heat exchanger 62 in the mentioned order. The refrigerant flowing to the second flow direction flows opposite to the first direction.

The flow direction switching mechanism 14 causes pipes to be connected in the following manner when the refrigerant flow direction is set to the second flow direction (herein, mentioned as while the second flow direction is selected). While the second flow direction is selected, the flow direction switching mechanism 14 causes the suction pipe l0*a* to communicate with the second gas refrigerant pipe 10*e*, and causes the discharge pipe 10*b* to communicate with the first gas refrigerant pipe 10*c* (see solid lines in the flow direction switching mechanism 14 depicted in FIG. 1). Specifically, while the second flow direction is selected, the flow direction switching mechanism 14 causes the suction side of the compressor 12 to communicate with the gas-refrigerant connection pipe 48 via the suction pipe 10*a* and the second gas refrigerant pipe 10*e*, and causes the discharge side of the compressor 12 to communicate with the gas side end of the heat source heat exchanger 20 via the discharge pipe 10*b* and the first gas refrigerant pipe 10*c*. When the flow direction switching mechanism 14 achieves connection of the pipes in this state, the refrigerant circuit 80 comes into a cooling operation state or a defrost operation state. While the second flow direction is selected, the heat source heat exchanger 20 functions as a refrigerant cooler (condenser) and the utilization heat exchanger 62 functions as a refrigerant heater (evaporator).

The flow direction switching mechanism 14 should not be limited to the four-way switching valve but may be alternatively configure by combining a plurality of electromagnetic valves and refrigerant pipes so as to switch the refrigerant flow direction as described above.

(2-2-3) Heat Source Heat Exchanger

The heat source heat exchanger 20 exemplifies the first heat exchange unit.

The heat source heat exchanger 20 causes heat exchange between a refrigerant and outdoor air. The heat source heat exchanger 20 has the liquid side end connected to the liquid refrigerant pipe 10*d*, and the gas side end connected to the first gas refrigerant pipe 10*c*.

The heat source heat exchanger 20 is exemplified by a fin-and-tube heat exchanger including heat transfer tubes (not depicted) and a large number of fins (not depicted). The heat source heat exchanger 20 should not be limited to the fin-and-tube heat exchanger in terms of its type, but may alternatively be of a different type.

The heat source heat exchanger 20 principally includes a header 21, a heat exchange unit 23 configured to cause heat exchange between a refrigerant and outdoor air, small-diameter pipes 24, the distributor 25, and a main pipe 26 (see FIG. 1). The heat exchange unit 23 includes the main heat exchange unit 22 and the sub heat exchange unit 28 (see FIG. 1). The main heat exchange unit 22 and the sub heat exchange unit 28 each includes heat transfer tubes (not depicted) and a large number of fins (not depicted).

The header 21 has a longitudinally extending tubular shape. The first gas refrigerant pipe 10*c* is connected to the header 21. The first gas refrigerant pipe 10*c* communicates with an internal space of the header 21. The first gas refrigerant pipe 10*c* is connected to a gas side connecting port 20*a* of the header 21. The header 21 is also connected to the main heat exchange unit 22 via a plurality of header connection pipes 21*a*. The internal space of the header 21 and the heat transfer tubes (not depicted) of the main heat exchange unit 22 communicate with each other via the header connection pipes 21*a*.

The main heat exchange unit 22 causes heat exchange between the refrigerant flowing in a plurality of heat transfer tubes (not depicted) of the main heat exchange unit 22 and outdoor air. The plurality of heat transfer tubes in the main heat exchange unit 22 preferably extends horizontally. The main heat exchange unit 22 includes the plurality of heat transfer tubes vertically sectioned into a plurality of groups, and the heat transfer tubes belonging to each of the plurality of groups constitute a refrigerant flow path independent from the other groups. Each of the refrigerant flow paths has one end connected to the corresponding header connection pipe 21*a* and the other end connected to the corresponding small-diameter pipe 24 (see FIG. 1). The small-diameter pipes 24 are each connected to a lower portion of the corresponding refrigerant flow path.

FIG. 1 depicts a state where three header connection pipes 21*a* and three small-diameter pipes 24 are connected to the main heat exchange unit 22. The main heat exchange unit 22 depicted in FIG. 1 has three refrigerant flow paths (a first refrigerant flow path 22*a*, a second refrigerant flow path 22*b*, and a third refrigerant flow path 22*c* disposed in the mentioned order from below). The state depicted in FIG. 1 is merely exemplified for description, and the main heat exchange unit 22 may alternatively be sectioned into two or at least four groups. The numbers of the header connection pipes 21*a* and the small-diameter pipes 24 may be determined based on the number of groups (the number of refrigerant flow paths).

Each of the small-diameter pipes 24 is connected to one of the independent refrigerant flow paths in the main heat exchange unit 22. The small-diameter pipes 24 according to the present embodiment include a first small-diameter pipe 24*a* connected to the first refrigerant flow path 22*a*, a second small-diameter pipe 24*b* connected to the second refrigerant flow path 22*b*, and a third small-diameter pipe 24*c* connected to the third refrigerant flow path 22*c*. The first small-diameter pipe 24*a*, the second small-diameter pipe 24*b*, and the third small-diameter pipe 24*c* each have an end opposite to an end connected to the main heat exchange unit 22 and connected to an upper end of the distributor 25.

The distributor 25 has the upper end connected to the plurality of small-diameter pipes 24 and a lower end connected to the single main pipe 26 (see FIG. 1). The main pipe 26 and the plurality of small-diameter pipes 24 communicate with each other in the distributor 25. The main pipe 26 has an end opposite to an end connected to the distributor 25 and connected to the sub heat exchange unit 28.

The sub heat exchange unit 28 is disposed below the main heat exchange unit 22. The sub heat exchange unit 28 should not be limitedly disposed below the main heat exchange unit 22. However, it is preferable that the sub heat exchange unit 28 in which relatively high temperature flows during heating operation is disposed below the main heat exchange unit 22 for reducing the formation of frost at a lower portion of a heat exchange unit being likely to have frost.

The sub heat exchange unit 28 causes heat exchange between the refrigerant flowing in the heat transfer tube (not depicted) of the sub heat exchange unit 28 and outdoor air. The sub heat exchange unit 28 includes a refrigerant flow path having one end connected to the main pipe 26 and the other end connected to the liquid refrigerant pipe 10*d*. The liquid refrigerant pipe 10*d* is connected to a liquid side connecting port 20*b* provided at the sub heat exchange unit 28.

In a case where the refrigerant flows in the heat source heat exchanger 20 from the first gas refrigerant pipe 10*c* toward the liquid refrigerant pipe 10*d* (while the second flow direction is selected, i.e. during cooling operation or defrost operation, see a refrigerant flow direction A indicated in FIG. 1), the refrigerant flows, in the heat source heat exchanger 20, to the internal space of the header 21, the header connection pipes 21*a*, the main heat exchange unit 22, the small-diameter pipes 24, the distributor 25, the main pipe 26, and the sub heat exchange unit 28 in the mentioned order. In another case where the refrigerant flows in the heat source heat exchanger 20 from the first gas refrigerant pipe 10*c* toward the liquid refrigerant pipe 10*d*, the heat source heat exchanger 20 functions as a cooler (condenser or radiator) configured to cool a refrigerant compressed by the compressor 12.

More specifically, the flow of the refrigerant in the heat source heat exchanger 20 from the first gas refrigerant pipe 10*c* toward the liquid refrigerant pipe 10*d* (while the second flow direction is selected) will be described below.

While the second flow direction is selected, the refrigerant (mainly in a gas phase) flowing in the first gas refrigerant pipe 10*c* flows into the internal space of the header 21 via the gas side connecting port 20*a*. The refrigerant flowed into the header 21 is divided into the three header connection pipes 21*a* to flow into the refrigerant flow paths (the first refrigerant flow path 22*a*, the second refrigerant flow path 22*b*, and the third refrigerant flow path 22*c*) in the main heat exchange unit 22. The refrigerant cooled in the first refrigerant flow path 22*a*, the second refrigerant flow path 22*b*, and the third refrigerant flow path 22*c* flows into the first small-diameter pipe 24*a*, the second small-diameter pipe 24*b*, and the third small-diameter pipe 24*c*, respectively, and then flows into the distributor 25.

The distributor 25 functions as a joining portion of the refrigerant flow paths in the refrigerant flow direction A while the second flow direction is selected.

The distributor 25 corresponds to an area reduced portion of the refrigerant flow paths in the refrigerant flow direction during cooling operation. The area reduced portion of the refrigerant flow paths herein corresponds to a portion having reduction in area of the refrigerant flow paths by at least 80% in comparison to an upstream portion.

The distributor 25 functions as a pressure loss portion configured to cause a pressure drop of a refrigerant flowing in the second flow direction. The pressure loss portion possibly has a larger pressure drop in comparison to an upstream portion. In other words, the pressure loss portion has friction loss or form loss larger than loss at an upstream portion when the refrigerant flows in the heat source heat exchanger 20 (when the refrigerant flows in the second flow direction in this case). Examples of the pressure loss portion may include, in addition to the joining portion of the refrigerant flow paths, a branching portion of the refrigerant flow paths, a curved portion of a refrigerant flow path, an expanding portion (including a rapidly expanding portion or a diffuser) of a refrigerant flow path, and a reducing portion (including a rapidly reducing portion or a nozzle) of a refrigerant flow path.

In a case where the refrigerant flows to the heat source heat exchanger 20 (when the refrigerant flows in the second flow direction in this case), the pressure loss portion has an average value of pressure loss (a change rate of a pressure drop) per unit flow path length being larger than twice the average value of pressure loss per unit flow path length at an upstream portion (in the heat source heat exchanger 20).

The refrigerant flowed into the distributor 25 passes the main pipe 26 and flows into the sub heat exchange unit 28. The refrigerant cooled by the sub heat exchange unit 28 flows into the liquid refrigerant pipe 10*d* via the liquid side connecting port 20*b* (an outlet of the condenser) provided at the sub heat exchange unit 28.

In another case where the refrigerant flows in the heat source heat exchanger 20 from the liquid refrigerant pipe 10*d* toward the first gas refrigerant pipe 10*c* (while the first flow direction is selected, i.e. during heating operation, see a refrigerant flow direction B indicated in FIG. 1), the refrigerant flows, in the heat source heat exchanger 20, to the sub heat exchange unit 28, the main pipe 26, the distributor 25, the small-diameter pipes 24, the main heat exchange unit 22, the header connection pipes 21*a*, and the internal space of the header 21 in the mentioned order. When the refrigerant flows in the heat source heat exchanger 20 from the liquid refrigerant pipe 10*d* toward the first gas refrigerant pipe 10*c*, the heat source heat exchanger 20 functions as a refrigerant heater (evaporator or heat absorber) configured to heat a refrigerant flowing from the utilization heat exchanger 62 functioning as a refrigerant cooler (condenser or radiator) via the expansion mechanism 18.

More specifically, the flow of the refrigerant in the heat source heat exchanger 20 from the liquid refrigerant pipe 10*d* toward the first gas refrigerant pipe 10*c* (while the first flow direction is selected) will be described below.

While the first flow direction is selected, the refrigerant (in a gas-liquid two-phase state) flowing from the liquid refrigerant pipe 10*d* into the heat source heat exchanger 20 flows into the sub heat exchange unit 28 via the liquid side connecting port 20*b*. The refrigerant heated by the sub heat exchange unit 28 passes the main pipe 26 and flows into the distributor 25.

The distributor 25 functions as a branching portion of the refrigerant flow paths in the refrigerant flow direction B while the first flow direction is selected.

The distributor 25 functions as a pressure loss portion configured to cause a pressure drop of a refrigerant flowing in the first flow direction. The pressure loss portion possibly has a larger pressure drop in comparison to an upstream portion. In other words, the pressure loss portion has friction loss or form loss larger than loss at an upstream portion when the refrigerant flows in the heat source heat exchanger 20 (when the refrigerant flows in the first flow direction in this case). Examples of the pressure loss portion may include, in addition to the branching portion of the refrigerant flow paths, a joining portion of the refrigerant flow paths, a curved portion of a refrigerant flow path, an expanding portion (including a rapidly expanding portion or a diffuser) of a refrigerant flow path, and a reducing portion (including a rapidly reducing portion or a nozzle) of a refrigerant flow path.

In a case where the refrigerant flows to the heat source heat exchanger 20 (when the refrigerant flows in the first flow direction in this case), the pressure loss portion has an average value of pressure loss (a change rate of a pressure drop) per unit flow path length being larger than twice the average value of pressure loss per unit flow path length at an upstream portion (in the heat source heat exchanger 20).

While the first flow direction is selected, the refrigerant divided at the distributor 25 flows into the first small-diameter pipe 24*a*, the second small-diameter pipe 24*b*, and the third small-diameter pipe 24*c*. The refrigerant flowed into the first small-diameter pipe 24*a*, the second small-diameter pipe 24*b*, and the third small-diameter pipe 24*c* flows into the first refrigerant flow path 22*a*, the second refrigerant flow path 22*b*, and the third refrigerant flow path 22*c*, respectively. The refrigerant heated while passing the first refrigerant flow path 22*a*, the second refrigerant flow path 22*b*, and the third refrigerant flow path 22*c* flows into the internal space of the header 21 via the header connection pipes 21*a*. The refrigerant flowed into the internal space of the header 21 flows into the first gas refrigerant pipe 10*c* via the gas side connecting port 20*a* of the heat source heat exchanger 20.

(2-2-4) Expansion Mechanism

The expansion mechanism 18 is disposed on the refrigerant flow path between the heat source heat exchanger 20 and the utilization heat exchanger 62 (see FIG. 1). The expansion mechanism 18 is configured to decompress a refrigerant flowing in the first flow direction (from the utilization heat exchanger 62 toward the heat source heat exchanger 20). The expansion mechanism 18 is also configured to decompress a refrigerant flowing in the second flow direction (from the heat source heat exchanger 20 toward the utilization heat exchanger 62). The expansion mechanism 18 is configured as an electric expansion valve having a controllable opening degree for control of a refrigerant flow rate or the like. The expansion mechanism 18 is provided on the liquid refrigerant pipe 10*d*. The opening degree of the expansion mechanism 18 is controlled by a controller 70 to be described later.

The expansion mechanism 18 should not be limited to the electric expansion valve but may alternatively be a different mechanism configured to decompress a refrigerant. Examples of the expansion mechanism 18 may include a capillary tube.

(2-2-5) Accumulator

The accumulator 16 is a vessel having a gas-liquid separation function of separating a refrigerant flowing into a gas refrigerant and a liquid refrigerant. The accumulator 16 is disposed upstream of the compressor 12 in the refrigerant flow direction (see FIG. 1). The accumulator 16 is provided on the suction pipe 10*a* in which a refrigerant flows to the suction side of the compressor 12. The refrigerant flowing into the accumulator 16 is divided into a gas refrigerant and a liquid refrigerant, and the gas refrigerant collecting in an upper space flows out toward the compressor 12.

(2-2-6) Bridge Circuit

The bridge circuit 32 is a mechanism configured to control a refrigerant flow direction. The bridge circuit 32 includes a first check valve 32*a*, a second check valve 32*b*, a third check valve 32*c*, and a fourth check valve 32*d* connected as depicted in FIG. 1 (see FIG. 1).

The first check valve 32*a* allows a refrigerant flow from the expansion mechanism 18 to the liquid-refrigerant connection pipe 46, and does not allow an opposite flow. The second check valve 32*b* allows a refrigerant flow from the expansion mechanism 18 to the heat source heat exchanger 20, and does not allow an opposite flow. The third check valve 32*c* allows a refrigerant flow from the liquid-refrigerant connection pipe 46 to the expansion mechanism 18 via the economiser heat exchanger 34, and does not allow an opposite flow. The fourth check valve 32*d* allows a refrigerant flow from the heat source heat exchanger 20 to the expansion mechanism 18 via the economiser heat exchanger 34, and does not allow an opposite flow.

During cooling operation or defrost operation, the bridge circuit 32 thus configured causes the refrigerant to flow from the heat source heat exchanger 20 to the expansion mechanism 18 via the fourth check valve 32*d*, and further causes the refrigerant to flow to the liquid-refrigerant connection pipe 46 via the first check valve 32*a*. During heating operation, the bridge circuit 32 thus configured causes the refrigerant to flow from the liquid-refrigerant connection pipe 46 to the expansion mechanism 18 via the third check valve 32*c*, and further causes the refrigerant to flow to the heat source heat exchanger 20 via the second check valve 32*b*.

(2-2-7) Economiser Heat Exchanger and Injection Valve

Examples of the economiser heat exchanger 34 include a double pipe heat exchanger and a plate heat exchanger. The economiser heat exchanger 34 has a first flow path 34*a* and a second flow path 34*b* (see FIG. 1), and is configured to cause heat exchange between a refrigerant flowing in the first flow path 34*a* and a refrigerant flowing in the second flow path 34*b*.

The first flow path 34*a* constitutes part of a refrigerant flow path for a refrigerant flowing from the bridge circuit 32 toward the expansion mechanism 18. The first flow path 34*a* allows a refrigerant to flow to the expansion mechanism 18 via the third check valve 32*c* or the fourth check valve 32*d* in the bridge circuit 32.

The second flow path 34*b* constitutes part of an injection flow path 35. The injection flow path 35 is a refrigerant flow path branching from a refrigerant pipe allowing a refrigerant to flow from the bridge circuit 32 toward the expansion mechanism 18 and communicating with a compression space (not depicted) during compression in the compression mechanism of the compressor 12. The second flow path 34*b* allows a flow of a refrigerant that branches from the refrigerant flow path in which refrigerant flowing from the bridge circuit 32 toward the expansion mechanism 18 through the third check valve 32*c* or the fourth check valve 32*d* in the bridge circuit 32, and then flows toward the compressor 12 via the injection valve 36.

The injection valve 36 is exemplarily configured as an electric valve having a controllable opening degree. The injection valve 36 is provided on a pipe connecting the refrigerant flow path for a refrigerant flowing from the bridge circuit 32 toward the expansion mechanism 18 and the second flow path 34*b* of the economiser heat exchanger 34.

When the injection valve 36 is opened, the refrigerant branching from the refrigerant flow path for a refrigerant flowing from the bridge circuit 32 toward the expansion mechanism 18 flows into the second flow path 34*b* of the economiser heat exchanger 34. The refrigerant flowed into the second flow path 34*b* exchanges heat with the refrigerant flowing in the first flow path 34*a* and becomes a refrigerant in the gas phase to be supplied to the compression space during compression in the compression mechanism of the compressor 12.

The injection valve 36 may alternatively be an electromagnetic valve simply controlled to open and close, instead of the electric valve having the controllable opening degree. When the injection valve 36 is configured as an electromagnetic valve, the injection flow path 35 is preferably provided with a capillary.

(2-2-8) Heat Source Fan

The heat source fan 30 is configured to suck outdoor air into the heat source unit 10, supply the sucked outdoor air to the heat source heat exchanger 20, and discharge air having exchanged heat with a refrigerant in the heat source heat exchanger 20 to the outside. The heat source fan 30 is configured to supply the heat source heat exchanger 20 with outdoor air as a cooling source or a heating source for the refrigerant flowing in the heat source heat exchanger 20. The heat source fan 30 is exemplified by an axial fan such as a propeller fan. The heat source fan 30 should not be limited to the axial fan but may be appropriately selected in terms of its type. The heat source fan 30 is driven by a fan motor 30*a* (see FIG. 1).

(2-2-9) Sensors

The heat source unit 10 includes various sensors. The sensors in the heat source unit 10 will be exemplified below. A temperature sensor or a pressure sensor to be described below is configured to measure desired temperature or pressure, and may be of any appropriately selected type.

The heat source unit 10 includes a suction temperature sensor 92*a* configured to measure suction temperature Ts of the compressor 12 (see FIG. 1). The heat source unit 10 further includes a discharge pressure sensor 94 configured to measure discharge pressure Pd of the compressor 12 (see FIG. 1). The heat source unit 10 further includes a discharge temperature sensor 92*b* configured to measure discharge temperature Td of the compressor 12 (see FIG. 1).

The heat source unit 10 further includes a first temperature sensor 92*c* and a second temperature sensor 92*d* (see FIG. 1). Each of the first temperature sensor 92*c* and the second temperature sensor 92*d* should not be limited in terms of its type, but may be exemplified by a thermistor.

The first temperature sensor 92*c* exemplifies the first refrigerant temperature measurement unit. The first temperature sensor 92*c* measures temperature, as first refrigerant temperature T1, of the refrigerant flowing in the main heat exchange unit 22 or between the main heat exchange unit 22 and the distributor 25 (the small-diameter pipes 24 in this case).

The first temperature sensor 92*c* is preferably configured to measure temperature of a refrigerant flowing downstream of a center (indicated by a dashed line C in FIG. 1) of the main heat exchange unit 22 disposed upstream of the distributor 25 and flowing upstream of the distributor 25 in the refrigerant flow direction A (the second flow direction). The measurement position of the first temperature sensor 92*c* is described with respect to the refrigerant flow direction A (the second flow direction) in this case simply for easier description, and the first temperature sensor 92*c* measures refrigerant temperature also in the case where the refrigerant flows in the flow direction B (the first flow direction). In order to avoid complicated description, the explanation of the measurement position of the first temperature sensor 92*c* with respect to the refrigerant flow direction B (the first direction) will be omitted herein.

The first temperature sensor 92*c* is more preferably configured to measure temperature of a refrigerant flowing in one of the plurality of pipes (the small-diameter pipes 24) connecting the main heat exchange unit 22 and the distributor 25. Furthermore, the first temperature sensor 92*c* is preferably configured to measure temperature of a refrigerant flowing in the small-diameter pipe 24 at a position downstream of a center (indicated by a dashed line N in FIG. 1) between the main heat exchange unit 22 and the distributor 25 in the refrigerant flow direction A (the second flow direction). The first temperature sensor 92*c* is preferably configured to measure temperature of a refrigerant flowing in the first small-diameter pipe 24*a* connected to the main heat exchange unit 22 at a lowest position (i.e. connected to the first refrigerant flow path 22*a*) among the small-diameter pipes 24 connected to (the first refrigerant flow path 22*a*, the second refrigerant flow path 22*b*, and the third refrigerant flow path 22*c* of) the main heat exchange unit 22 at different levels.

The first temperature sensor 92*c* should not be limited in terms of its measurement position of refrigerant temperature, and is attached, in the practical example of FIG. 1, to the first small-diameter pipe 24*a* at a position downstream of the center (indicated by the dashed line N) between the main heat exchange unit 22 and the distributor 25 in the refrigerant flow direction A (the second flow direction). The first temperature sensor 92*c* measures temperature of the refrigerant flowing in the first small-diameter pipe 24*a* at its attached position. According to the practical example of FIG. 1, the first temperature sensor 92*c* is attached on the first small-diameter pipe 24*a* at a position adjacent to the distributor 25, and measures temperature of the refrigerant flowing in the first small-diameter pipe 24*a* at the attached position.

The second temperature sensor 92*d* exemplifies the second refrigerant temperature measurement unit. The second temperature sensor 92*d* is configured to measure, as second refrigerant temperature T2, temperature of a refrigerant downstream of the distributor 25 (the pressure loss portion) of the heat source heat exchanger 20 and upstream of the expansion mechanism 18 in the refrigerant flow direction A (the second flow direction). The second temperature sensor 92*d* measures, as the second refrigerant temperature T2, temperature of the refrigerant flowing from the distributor 25 to the expansion mechanism 18 in the second flow direction and temperature of the refrigerant flowing from the expansion mechanism 18 to the distributor 25 in the first flow direction.

The second temperature sensor 92*d* should not be limited in terms of its measurement position of refrigerant temperature, and is configured, in the practical example of FIG. 1, to measure, as the second refrigerant temperature T2, temperature of a refrigerant flowing in the liquid refrigerant pipe 10*d* downstream of the distributor 25 (the pressure loss portion) of the heat source heat exchanger 20 and upstream of the expansion mechanism 18 in the refrigerant flow direction A (the second flow direction). In other words, the second temperature sensor 92*d* is configured to measure, as the second refrigerant temperature T2, temperature of the refrigerant flowing in the liquid refrigerant pipe 10*d* downstream of the expansion mechanism 18 and upstream of the distributor 25 (the pressure loss portion) of the heat source heat exchanger 20 in the refrigerant flow direction B (the first flow direction).

The heat source unit 10 further includes a liquid pipe temperature sensor 92*e* provided on the liquid refrigerant pipe 10*d* between the bridge circuit 32 and the liquid-side shutoff valve 42 (on a pipe connecting the liquid-side shutoff valve 42 and a pipe connecting a downstream end of the first check valve 32*a* and an upstream side of the third check valve 32*c* in the bridge circuit 32). The liquid pipe temperature sensor 92*e* is configured to measure temperature Tlp of a refrigerant sent from the bridge circuit 32 to the liquid-refrigerant connection pipe 46 or a refrigerant sent from the liquid-refrigerant connection pipe 46 to the bridge circuit 32.

The heat source unit 10 further includes an outside air temperature sensor 96 configured to measure air temperature Toa around the heat source heat exchanger 20. The outside air temperature sensor 96 exemplifies the air temperature measurement unit.

(2-2-10) Heat Source Control Unit

The heat source control unit 72 controls operation of the respective parts of the heat source unit 10. The heat source control unit 72 includes a microcomputer, a memory, and the like provided for control of the heat source unit 10. The heat source control unit 72 is configured to transmit and receive control signals and the like to and from the utilization control unit 74 of the utilization unit 60 via the communication line.

The heat source control unit 72 of the heat source unit 10 and the utilization control unit 74 of the utilization unit 60 are communicably connected via the communication line to constitute the controller 70 configured to control operation of the entire refrigerant cycle apparatus 100. The controller 70 controls operation of the entire refrigerant cycle apparatus 100 through execution of a program stored in the memory by the microcomputer.

The controller 70 according to the present embodiment merely exemplifies a control device of the refrigerant cycle apparatus 100. The controller may achieve functions similar to functions of the controller 70 according to the present embodiment by means of hardware such as a logic circuit or a combination of hardware and software.

The controller 70 herein is constituted by the heat source control unit 72 and the utilization control unit 74, but should not be limited thereto. The refrigerant cycle apparatus 100 may include, in addition to or in place of the heat source control unit 72 and the utilization control unit 74, a control device provided separately from the heat source unit 10 and the utilization unit 60 and configured to achieve part or all of functions to be described below.

Figure 2:
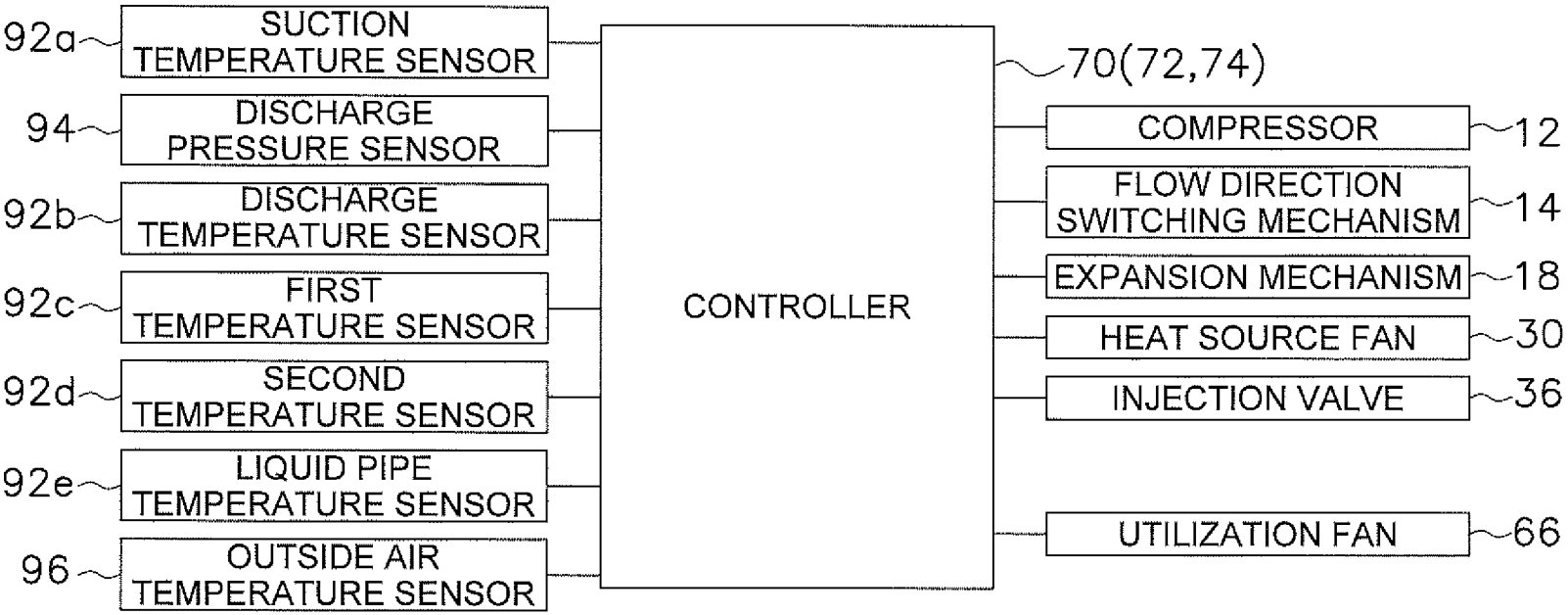
FIG. 2 is a block diagram of the refrigerant cycle apparatus depicted in FIG. 1.

As depicted in FIG. 2, the controller 70 is connected to receive measurement signals of the temperature sensors 92*a* to 92*e* configured to measure refrigerant temperature, the discharge pressure sensor 94, and the outside air temperature sensor 96. The controller 70 is connected to the compressor 12, the flow direction switching mechanism 14, the expansion mechanism 18, the heat source fan 30, the injection valve 36, and the utilization fan 66, to control these devices 12, 14, 18, 30, 36, and 66 based on the measurement signals from the sensors.

The controller 70 controls the compressor 12, the flow direction switching mechanism 14, the expansion mechanism 18, the heat source fan 30, the injection valve 36, the utilization fan 66, and the like to cause the refrigerant cycle apparatus 100 to execute cooling operation, heating operation, or defrost operation. The controller 70 exemplifies the operation control unit, and is configured to control the flow direction switching mechanism 14 to switch between heating operation (normal operation) of causing a refrigerant to flow in the first flow direction and defrost operation of causing a refrigerant to flow in the second flow direction.

(3) Operation of Refrigerant Cycle Apparatus

Operation of the refrigerant cycle apparatus 100 controlled by the controller 70 during cooling operation, heating operation, and defrost operation will be described hereinafter.

(3-1) Operation During Cooling Operation

When cooling operation is commanded by means of the remote controller (not depicted) or the like, the controller 70 controls the flow direction switching mechanism 14 such that the refrigerant flows in the second flow direction (such that the flow direction switching mechanism 14 comes into a state indicated by the solid lines in FIG. 1).

The controller 70 controls operation of the compressor 12, the heat source fan 30, and the utilization fan 66 based on the measurement signals from the sensors. Though not limited, the controller 70 controls a number of rotations of the compressor 12 based on evaporation temperature at the utilization heat exchanger 62 or the like. The controller 70 controls operation of the expansion mechanism 18 and the injection valve 36 to achieve predetermined operation based on the measurement signals from the sensors. Though not limited, the controller 70 controls the expansion mechanism 18 based on a degree of subcooling or the like, and controls operation of the injection valve 36 based on a degree of discharge superheating or the like.

During cooling operation, a low-pressure gas refrigerant in the refrigerant circuit 80 is sucked into the compressor 12 to be compressed into a high-pressure gas refrigerant. The gas refrigerant compressed by the compressor 12 is sent to the heat source heat exchanger 20 via the flow direction switching mechanism 14.

The high-pressure gas refrigerant sent to the heat source heat exchanger 20 exchanges heat with outdoor air supplied by the heat source fan 30 in the heat source heat exchanger 20 functioning as a refrigerant cooler (condenser) to be cooled and condensed into a high-pressure liquid refrigerant. The liquid refrigerant condensed by the heat source heat exchanger 20 is decompressed to expand by the expansion mechanism 18, and is sent to the utilization unit 60 via the liquid-side shutoff valve 42 and the liquid-refrigerant connection pipe 46.

When the injection valve 36 is opened, the liquid refrigerant condensed by the heat source heat exchanger 20 is further cooled by the economiser heat exchanger 34 before being decompressed by the expansion mechanism 18. When the injection valve 36 is opened, part of the liquid refrigerant flowing in the liquid refrigerant pipe 10*d* branches into the injection flow path 35 to be decompressed by the injection valve 36. The refrigerant decompressed by the injection valve 36 is sent to the economiser heat exchanger 34, exchanges heat with a high-pressure liquid refrigerant flowing in the liquid refrigerant pipe 10*d* to be heated and evaporated, and is injected into the compression space during compression in the compression mechanism of the compressor 12.

The refrigerant sent to the utilization unit 60 is sent to the utilization heat exchanger 62. A low-pressure refrigerant in the gas-liquid two-phase state sent to the utilization heat exchanger 62 exchanges heat with indoor air supplied by the utilization fan 66 in the utilization heat exchanger 62 functioning as a refrigerant heater (evaporator) to be heated and evaporated into a low-pressure gas refrigerant. The low-pressure gas refrigerant is sent from the utilization unit 60 to the heat source unit 10 via the gas-refrigerant connection pipe 48.

The low-pressure gas refrigerant sent to the heat source unit 10 is sucked into the compressor 12 again via the gas-side shutoff valve 44 and the flow direction switching mechanism 14.

(3-2) Operation During Heating Operation

When heating operation is commanded by means of the remote controller (not depicted) or the like, the controller 70 controls the flow direction switching mechanism 14 such that the refrigerant flows in the first flow direction (such that the flow direction switching mechanism 14 comes into a state indicated by the broken lines in FIG. 1).

The controller 70 controls operation of the compressor 12, the heat source fan 30, and the utilization fan 66 based on the measurement signals from the sensors. Though not limited, the controller 70 controls the number of rotations of the compressor 12 based on condensation temperature at the utilization heat exchanger 62 or the like. The controller 70 controls operation of the expansion mechanism 18 and the injection valve 36 to achieve predetermined operation based on the measurement signals from the sensors. Though not limited, the controller 70 controls the expansion mechanism 18 based on a degree of subcooling or the like, and controls operation of the injection valve 36 based on a degree of discharge superheating or the like.

During heating operation, a low-pressure gas refrigerant circuit in the refrigerant circuit 80 is sucked into the compressor 12 to be compressed into a high-pressure gas refrigerant. The gas refrigerant compressed by the compressor 12 is sent from the heat source unit 10 to the utilization unit 60 via the flow direction switching mechanism 14, the gas-side shutoff valve 44, and the gas-refrigerant connection pipe 48.

The high-pressure gas refrigerant sent to the utilization unit 60 is sent to the utilization heat exchanger 62. The high-pressure gas refrigerant sent to the utilization heat exchanger 62 exchanges heat with indoor air supplied by the utilization fan 66 in the utilization heat exchanger 62 functioning as a refrigerant cooler (condenser or radiator) to be cooled and condensed into a high-pressure liquid refrigerant. The high-pressure liquid refrigerant is sent from the utilization unit 60 to the heat source unit 10 via the liquid-refrigerant connection pipe 46.

The refrigerant sent to the heat source unit 10 is sent to the expansion mechanism 18 and is decompressed by the expansion mechanism 18 into a refrigerant in the gas-liquid two-phase state. The refrigerant in the gas-liquid two-phase state is sent to the heat source heat exchanger 20.

When the injection valve 36 is opened, the refrigerant sent to the heat source unit 10 is further cooled by the economiser heat exchanger 34 before being decompressed by the expansion mechanism 18. When the injection valve 36 is opened, part of the liquid refrigerant flowing in the liquid refrigerant pipe 10*d* branches into the injection flow path 35 to be decompressed by the injection valve 36. The refrigerant decompressed by the injection valve 36 is sent to the economiser heat exchanger 34, exchanges heat with a high-pressure liquid refrigerant flowing in the liquid refrigerant pipe 10*d* to be heated and evaporated, and is injected into the compression space during compression in the compression mechanism of the compressor 12.

The refrigerant in the gas-liquid two-phase state sent to the heat source heat exchanger 20 exchanges heat with outdoor air supplied by the heat source fan 30 in the heat source heat exchanger 20 functioning as a refrigerant evaporator to be heated and evaporated into a low-pressure gas refrigerant. The low-pressure gas refrigerant is sucked into the compressor 12 again via the flow direction switching mechanism 14.

A relation between temperature of a refrigerant flowing in the sub heat exchange unit 28 of the heat source heat exchanger 20 and temperature of a refrigerant flowing in the main heat exchange unit 22 of the heat source heat exchanger 20 during heating operation will be described with reference to a refrigeration cycle depicted in FIG. 3.

Figure 3:
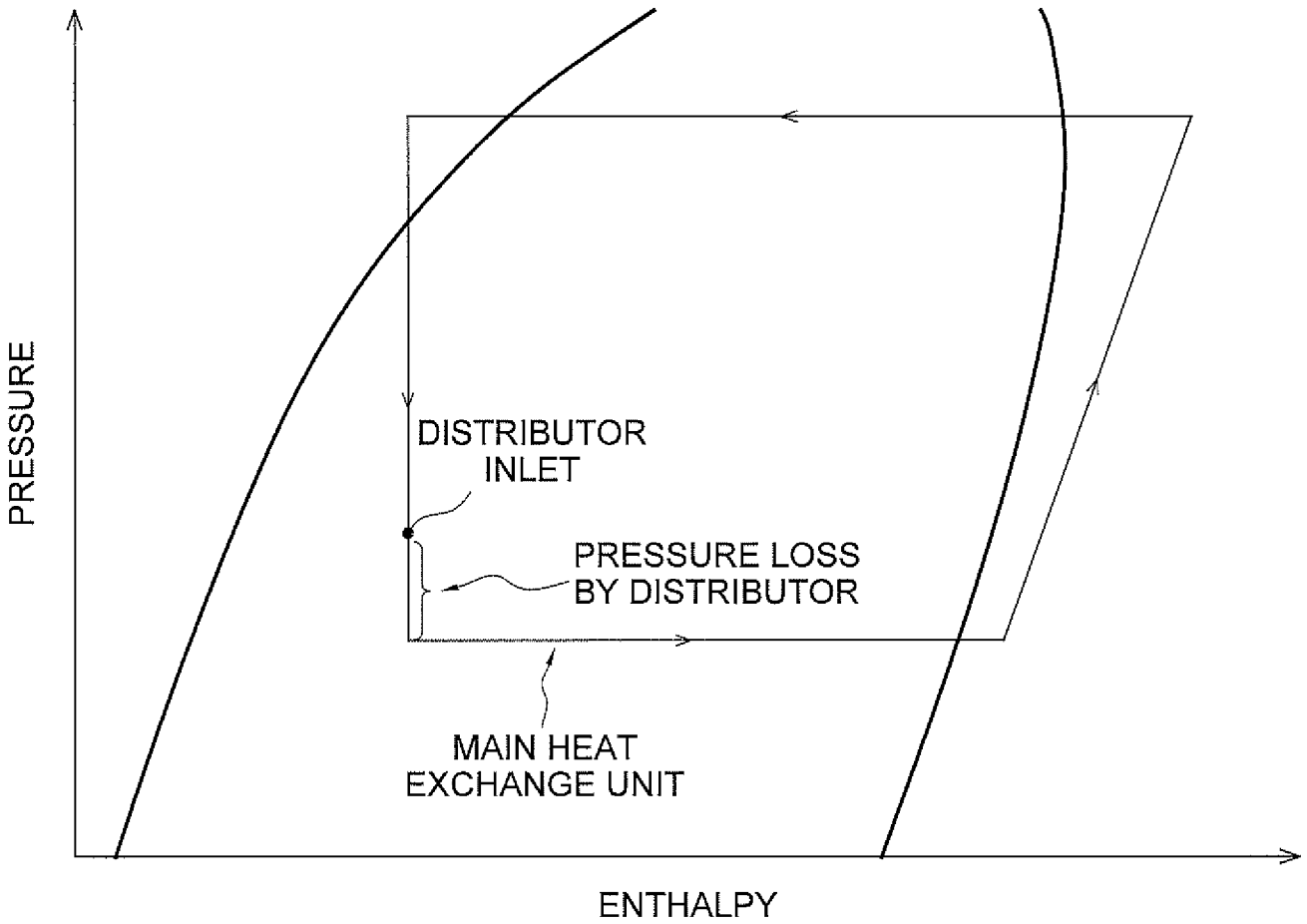
FIG. 3 is a pressure-enthalpy graph of a schematic explanatory refrigeration cycle indicating a relation between temperature of a refrigerant flowing in a sub heat exchange unit and temperature of a refrigerant flowing in a main heat exchange unit during heating operation.

The heat source heat exchanger 20 includes the distributor 25 functioning as the pressure loss portion, so that a refrigerant at an inlet of the distributor 25 is higher in pressure than a low-pressure refrigerant flowing in the main heat exchange unit 22 (see FIG. 3). The refrigerant at the inlet of the distributor 25 is accordingly higher in temperature than the refrigerant flowing in the main heat exchange unit 22. In other words, the refrigerant flowing in the sub heat exchange unit 28 upstream of the distributor 25 is higher in temperature than the refrigerant flowing in the main heat exchange unit 22 downstream of the distributor 25 in the first flow direction.

Even in a case where the refrigerant flowing in the main heat exchange unit 22 has temperature possibly causing frost at the main heat exchange unit 22, the refrigerant flowing in the sub heat exchange unit 28 may have temperature not causing frost at the sub heat exchange unit 28. Furthermore, the refrigerant flowing in the sub heat exchange unit 28 may have temperature allowing frost to melt even if the frost is formed at the sub heat exchange unit 28 for some reason.

Further, in this embodiment, the sub heat exchange unit 28, in which a refrigerant having relatively high temperature to flow during heating operation, is disposed below the main heat exchange unit 22 as described earlier. It is therefore possible to reduce the formation of frost at a lower portion of the heat source heat exchanger 20.

(3-3) Operation During Defrost Operation

If the controller 70 determines that a predetermined defrost start condition is satisfied during heating operation, the controller 70 controls the flow direction switching mechanism 14 to temporarily stop heating operation of causing a refrigerant to flow in the first flow direction and switch to defrost operation of causing the refrigerant to flow in the second flow direction. When the defrost start condition is satisfied, the heat source heat exchanger 20 is desired to be defrosted. Though not limited, the controller 70 determines that the defrost start condition is satisfied in a case where the first refrigerant temperature T1 measured by the first temperature sensor 92*c* becomes equal to or less than predetermined temperature (e.g. −5° C.) or a case where predetermined time (e.g. two hours) has elapsed after heating operation starts.

Described in detail below is control by the controller 70 of the refrigerant cycle apparatus 100 during defrost operation.

When the controller 70 determines that the defrost start condition is satisfied during heating operation, the controller 70 stops controlling various devices for heating operation and causes the various devices to execute operation for preparation of defrost operation. For example, the controller 70 reduces the number of rotations of the compressor 12 to a predetermined number of rotations, and controls the expansion mechanism 18 to have a predetermined opening degree.

At predetermined timing, the controller 70 controls the flow direction switching mechanism 14 to switch the refrigerant flow direction from the first flow direction to the second flow direction. That is, the controller 70 controls the flow direction switching mechanism 14 at the predetermined timing such that the flow direction switching mechanism 14 comes into the state indicated by the solid lines in FIG. 1. The refrigerant cycle apparatus 100 is thus switched to defrost operation of causing a refrigerant to flow in the second flow direction.

For example, the controller 70 controls the compressor 12 and the expansion mechanism 18 during defrost operation such that the compressor 12 executes predetermined operation and the expansion mechanism 18 has a predetermined opening degree. For example, the controller 70 controls the heat source fan 30 and the utilization fan 66 during defrost operation to stop the heat source fan 30 and the utilization fan 66. Control by the controller 70 of respective parts of the refrigerant cycle apparatus 100 during defrost operation should not be limited to the above. The controller 70 may control the respective parts of the refrigerant cycle apparatus 100 for appropriate defrosting at the heat source heat exchanger 20.

The controller 70 terminates defrost operations in the following manner after the defrost operation starts.

Two control modes for the defrost operation differentiated by termination conditions will be described.

The controller 70 has, as the control modes for the defrost operation, a first defrost control mode of terminating defrost operation based on the first refrigerant temperature T1 and a second defrost control mode of terminating defrost operation based on the second refrigerant temperature T2.

The controller 70 in the first defrost control mode determines termination of defrost operation, in a case where the first refrigerant temperature T1 measured by the first temperature sensor 92*c* is equal to or more than first defrost termination determination temperature and such a state lasts for at least first predetermined time after the defrost operation starts.

The controller 70 in the second defrost control mode determines termination of defrost operation, in a case where the second refrigerant temperature T2 measured by the second temperature sensor 92*d* is equal to or more than second defrost termination determination temperature and such a state lasts for at least second predetermined time after the defrost operation starts.

Herein, the first defrost termination determination temperature is equal to the second defrost termination determination temperature, and the first predetermined time is equal to the second predetermined time. Alternatively, the first defrost termination determination temperature and the second defrost termination determination temperature, and/or the first predetermined time and the second predetermined time may alternatively be different from each other.

Defrost operation termination determination by the controller 70 in the defrost control modes should not be limited to the above methods. The controller 70 may alternatively determine termination of defrost operation in the first defrost control mode if the first refrigerant temperature T1 becomes equal to or more than the first defrost termination determination temperature (without determining whether or not the state lasts). The same applies to defrost operation termination determination by the controller 70 in the second defrost control mode.

Figure 4:
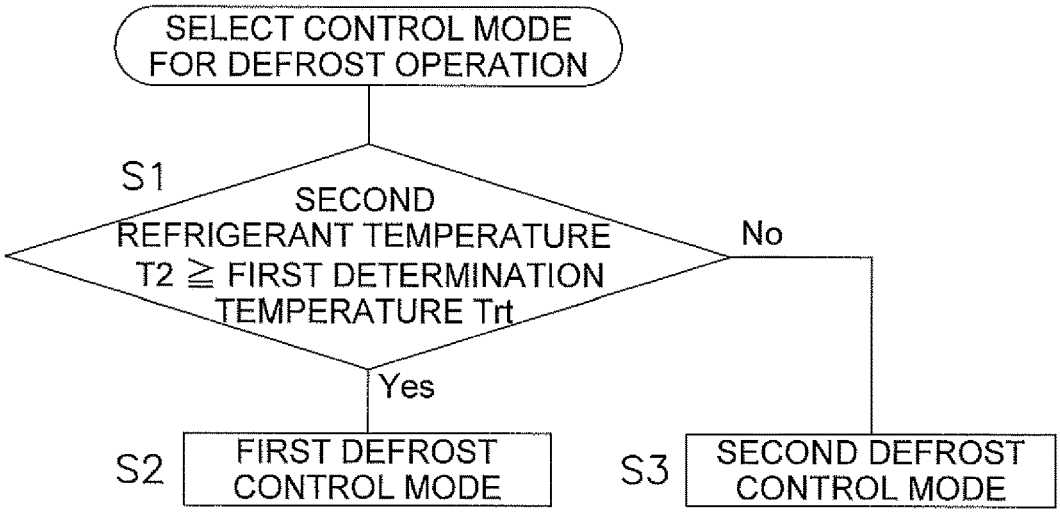
FIG. 4 is an explanatory flowchart depicting selection between control modes for the defrost operation of the refrigerant cycle apparatus depicted in FIG. 1.

The controller 70 selects one of the two defrost control modes based on a flowchart in FIG. 4 for example, and determines termination of defrost operation based on the control mode thus selected. The controller 70 selects an applicable one of the control modes for the defrost operation when the defrost start condition is satisfied. Selection of the control mode for defrost operation should not be limited to such timing when the defrost start condition is satisfied, but may alternatively be made when the defrost operation starts, for example.

According to the flowchart in FIG. 4, the controller 70 acquires the second refrigerant temperature T2 measured before defrost operation starts, and selects an applicable one of the control modes based on the second refrigerant temperature T2 thus acquired. For example, the controller 70 acquires the second refrigerant temperature T2 measured before defrost operation starts, and compares the second refrigerant temperature T2 with first determination temperature Trt to select an applicable one of the control modes based on a comparison result (step S1). Examples of the first determination temperature Trt include temperature less likely to cause frost at the sub heat exchange unit 28 when a refrigerant having temperature equal to or more than the first determination temperature Trt flows into the sub heat exchange unit 28. The examples of the first determination temperature Trt may also include temperature expected to allow frost on the sub heat exchange unit 28 to melt when a refrigerant having temperature equal to or more than the first determination temperature Trt flows into the sub heat exchange unit 28.

The controller 70 according to the present embodiment acquires the second refrigerant temperature T2 measured during heating operation before defrost operation starts. For example, the controller 70 acquires the second refrigerant temperature T2 measured by the second temperature sensor 92*d* when the controller 70 determines that the defrost start condition is satisfied during heating operation. The controller 70 may acquire, instead of the second refrigerant temperature T2 measured by the second temperature sensor 92*d* at a certain moment, a representative value of the second refrigerant temperature T2 measured by the second temperature sensor 92*d* during a predetermined period (e.g. a maximum value, an average value, an intermediate value, or the like of the second refrigerant temperature T2 measured by the second temperature sensor 92*d* during the predetermined period).

The controller 70 executes defrost operation in the first defrost control mode if the second refrigerant temperature T2 is determined as being equal to or more than the first determination temperature Trt in step S1 (step S2). In other words, if the second refrigerant temperature T2 is determined as being equal to or more than the first determination temperature Trt, the controller 70 determines termination of defrost operation based on the first refrigerant temperature T1 measured by the first temperature sensor 92*c*.

The controller 70 executes defrost operation in the second defrost control mode if the second refrigerant temperature T2 is determined as being less than the first determination temperature Trt in step S1 (step S3). In other words, if the second refrigerant temperature T2 is determined as being less than the first determination temperature Trt, the controller 70 determines termination of defrost operation based on the second refrigerant temperature T2 measured by the second temperature sensor 92*d*.

When the controller 70 executes defrost operation in either the first defrost control mode or the second defrost control mode and determines termination of the defrost operation, the controller 70 reduces the number of rotations of the compressor 12 (or stops the compressor 12), and increases the opening degree of the expansion mechanism 18 to a predetermined opening degree for pressure equalization between a high-pressure side and a low-pressure side. The controller 70 controls the flow direction switching mechanism 14 at predetermined timing such that the flow direction switching mechanism 14 comes into the state indicated by the broken lines in FIG. 1, to switch the refrigerant flow direction from the second flow direction to the first flow direction. The refrigerant cycle apparatus 100 accordingly terminates defrost operation and restarts heating operation.

(4) Characteristics (4-1)

The refrigerant cycle apparatus 100 according to the present embodiment includes the refrigerant circuit 80, the first temperature sensor 92*c* exemplifying the first refrigerant temperature measurement unit, the second temperature sensor 92*d* exemplifying the second refrigerant temperature measurement unit, and the controller 70 exemplifying the operation control unit. The refrigerant circuit 80 includes the compressor 12, the heat source heat exchanger 20 exemplifying the first heat exchange unit, the utilization heat exchanger 62 exemplifying the second heat exchange unit, the expansion mechanism 18, and the flow direction switching mechanism 14. The compressor 12 compresses the refrigerant. The heat source heat exchanger 20 includes the main heat exchange unit 22, the sub heat exchange unit 28, and the distributor 25 disposed on the refrigerant flow path between the main heat exchange unit 22 and the sub heat exchange unit 28. The distributor 25 exemplifies the pressure loss portion. The expansion mechanism 18 is disposed on the refrigerant flow path between the heat source heat exchanger 20 and the utilization heat exchanger 62, and decompresses the refrigerant. The flow direction switching mechanism 14 switches the flow direction of the refrigerant discharged from the compressor 12, between the first flow direction and the second flow direction. The refrigerant flowing in the first flow direction flows to the utilization heat exchanger 62, the expansion mechanism 18, the sub heat exchange unit 28, the distributor 25, and the main heat exchange unit 22 in the mentioned order. The refrigerant flowing in the second flow direction flows to the main heat exchange unit 22, the distributor 25, the sub heat exchange unit 28, the expansion mechanism 18, and the utilization heat exchanger 62 in the mentioned order. The refrigerant flowing in the second flow direction flows in a direction opposite to the first flow direction. The first temperature sensor 92*c* measures temperature, as the first refrigerant temperature T1, of the refrigerant flowing in the main heat exchange unit 22 or between the main heat exchange unit 22 and the distributor 25. Though not limited, the first temperature sensor 92*c* according to the present embodiment measures temperature, as the first refrigerant temperature T1, of the refrigerant flowing in the small-diameter pipe 24 between the main heat exchange unit 22 and the distributor 25. The second temperature sensor 92*d* measures temperature, as the second refrigerant temperature T2, of the refrigerant flowing between the distributor 25 and the expansion mechanism 18. Though not limited, the second temperature sensor 92*d* according to the present embodiment measures temperature, as the second refrigerant temperature T2, of the refrigerant flowing in the liquid refrigerant pipe 10*d* between the distributor 25 and the expansion mechanism 18. The controller 70 controls the flow direction switching mechanism 14 to switch between heating operation of causing the refrigerant to flow in the first flow direction and defrost operation of causing the refrigerant to flow in the second flow direction. The heating operation exemplifies normal operation. The controller 70 has the control modes for the defrost operation, including at least the first defrost control mode and the second defrost control mode. In the first defrost control mode, the controller 70 terminates the defrost operation based on the first refrigerant temperature T1. In the second defrost control mode, the controller 70 terminates the defrost operation based on the second refrigerant temperature T2.

The heat source heat exchanger 20 according to the present embodiment includes the main heat exchange unit 22, the sub heat exchange unit 28, and the pressure loss portion (the distributor 25 in the present embodiment) disposed on the refrigerant flow path between the main heat exchange unit 22 and the sub heat exchange unit 28. The heat source heat exchanger 20 is configured to cause the refrigerant to flow to the sub heat exchange unit 28, the distributor 25, and the main heat exchange unit 22 in the mentioned order during the normal operation (heating operation), and to flow in a direction opposite to the direction of the heating operation during the defrost operation.

In the heat source heat exchanger 20 thus configured, the sub heat exchange unit 28 is disposed upstream of the distributor 25 causing a pressure drop of the refrigerant in the refrigerant flow direction during the heating operation. The refrigerant flowing in the sub heat exchange unit 28 is thus higher in temperature than the refrigerant flowing in the main heat exchange unit 22 during the heating operation (see FIG. 3). Even when the heat source heat exchanger 20 functions as a refrigerant heater (evaporator), the sub heat exchange unit 28 is less likely to have problematic frost. For example, even in a case where the main heat exchange unit 22 is desired to be defrosted, the sub heat exchange unit 28 may not need defrosting in some cases.

If the defrost operation is terminated based on the second refrigerant temperature T2, the second refrigerant temperature T2 rises only after the temperature of the entire heat source heat exchanger 20 rises. Therefore, even in a case where the sub heat exchange unit 28 does not need defrosting, the defrost operation may not be terminated until the entire heat source heat exchanger 20 including the sub heat exchange unit 28 rises. Thus, the defrost operation may be unnecessarily prolonged.

In contrast, the present refrigerant cycle apparatus 100 has, as a control mode for the defrost operation, the first defrost control mode of determining termination of the defrost operation based on the first refrigerant temperature T1. The present refrigerant cycle apparatus 100 operating in the first defrost control mode is configured to terminate the defrost operation based on a defrosting status at the main heat exchange unit 22, to suppress extension of defrost time when the sub heat exchange unit 28 does not particularly need defrosting.

The present refrigerant cycle apparatus 100 also has, as a control mode for the defrost operation, the second defrost control mode of determining termination of the defrost operation based on the second refrigerant temperature T2. Therefore, in a case where the sub heat exchange unit 28 is desired to be defrosted, this configuration suppresses frost from remaining unmelted in the entire heat source heat exchanger 20 including the sub heat exchange unit 28.

(4-2)

The controller 70 in the refrigerant cycle apparatus 100 according to the present embodiment executes the defrost operation in the first defrost control mode if the second refrigerant temperature T2 measured before the defrost operation starts is equal to or more than the first determination temperature Trt. The first determination temperature Trt exemplifies the first temperature.

The second refrigerant temperature T2 measured before the defrost operation starts being relatively high indicates that the temperature of the refrigerant at the sub heat exchange unit 28 is relatively high. The sub heat exchange unit 28 having relatively high temperature of the refrigerant is less likely to have problematic frost.

The present refrigerant cycle apparatus 100 executes the defrost operation in the first defrost control mode when the second refrigerant temperature T2 before the defrost operation starts is relatively high. This configuration is thus likely to suppress unnecessary extension of the defrost time.

(4-3)

The controller 70 in the refrigerant cycle apparatus 100 according to the present embodiment particularly executes the defrost operation in the first defrost control mode when the second refrigerant temperature T2 measured during the heating operation (normal operation) before the defrost operation starts is equal to or more than the first determination temperature Trt.

The second refrigerant temperature T2 measured during the heating operation being relatively high indicates that the temperature of the refrigerant flowing in the sub heat exchange unit 28 during the heating operation is relatively high. When the refrigerant flowing in the sub heat exchange unit 28 has relatively high temperature during the heating operation, the sub heat exchange unit 28 is less likely to have problematic frost. Further, in the case where the refrigerant flowing in the sub heat exchange unit 28 during the heating operation has relatively high temperature, even if the sub heat exchange unit 28 has frost for some reason, the frost is expected to melt during the heating operation.

The present refrigerant cycle apparatus 100 executes the defrost operation in the first defrost control mode if the second refrigerant temperature T2 measured during the normal operation is relatively high. This configuration is thus likely to suppress unnecessary extension of the defrost time.

The controller 70 according to the present embodiment selects one of the control modes for the defrost operation based on the second refrigerant temperature T2 measured during the normal operation (during the heating operation). However, the present disclosure should not be limited to such a case. The controller 70 may alternatively select one of the control modes for the defrost operation based on the second refrigerant temperature T2 measured before the defrost operation starts after the normal operation (heating operation) is stopped (e.g. during operation for preparation of the defrost operation before the refrigerant flow direction is switched from the first flow direction to the second flow direction).

(4-4)

The controller 70 in the refrigerant cycle apparatus 100 according to the present embodiment executes the defrost operation in the second defrost control mode when the measured second refrigerant temperature T2 is less than the first determination temperature Trt.

When the measured second refrigerant temperature T2 is relatively low, the sub heat exchange unit 28 also possibly has problematic frost. The present refrigerant cycle apparatus 100 executes the defrost operation in the second defrost control mode when the second refrigerant temperature T2 thus measured is relatively low. Therefore, it is likely to suppress frost from remaining unmelted at the heat source heat exchanger 20 including the sub heat exchange unit 28.

(5) Modification Examples

The modification examples of the above embodiment will be described hereinafter. Any one of the following modification examples may be combined with part or all of the configurations according to the above embodiment and the other modification examples where appropriate within ranges having no contradiction.

(5-1) Modification Example A

The controller 70 according to the above embodiment selects one of the control modes for the defrost operation based on the second refrigerant temperature acquired by the second temperature sensor 92*d*. However, the present disclosure should not be limited to such a case. The controller 70 may alternatively select an applicable one of the control modes for the defrost operation based on the air temperature Toa around the heat source heat exchanger 20 measured by the outside air temperature sensor 96 exemplifying the air temperature measurement unit.

Figure 5:
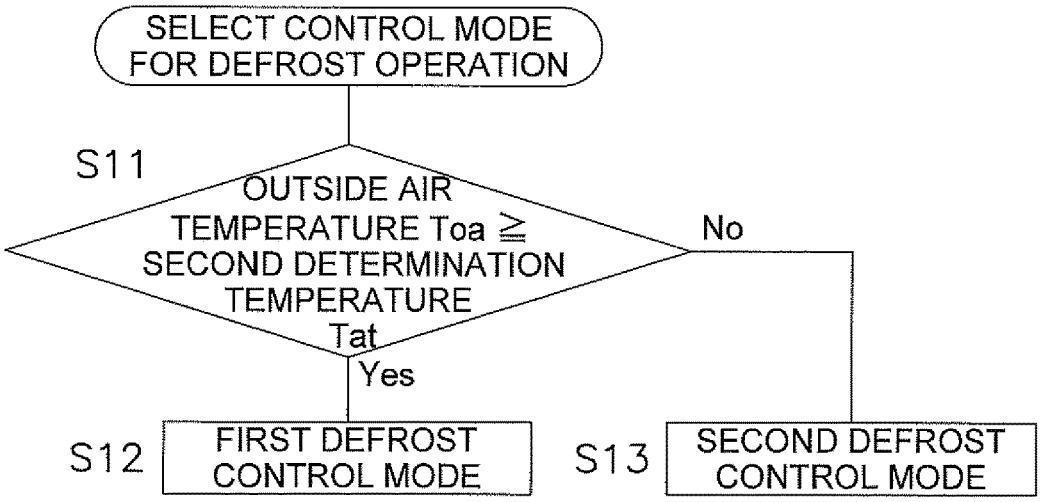
FIG. 5 is an explanatory flowchart depicting selection between control modes for defrost operation of a refrigerant cycle apparatus according to a modification example A.

For example, the controller 70 may select an applicable one of the control modes for the defrost operation based on a flowchart depicted in FIG. 5.

The controller 70 acquires the air temperature Toa measured by the outside air temperature sensor 96, and selects an applicable one of the control modes based on the air temperature Toa thus acquired. For example, the controller 70 compares the current air temperature Toa with second determination temperature Tat to select an applicable one of the control modes based on a comparison result (step S11). Examples of the second determination temperature Tat include temperature less likely to cause frost at the sub heat exchange unit 28 when the outside air temperature is equal to or more than the second determination temperature Tat. The examples of the second determination temperature Tat may also include temperature expected to allow frost to melt even when the sub heat exchange unit 28 has the frost.

The controller 70 may acquire the air temperature Toa measured by the outside air temperature sensor 96 at a certain moment, or acquire a representative value of the air temperature Toa measured by the outside air temperature sensor 96 during a predetermined period (e.g. a maximum value, an average value, an intermediate value, or the like of the air temperature Toa measured by the outside air temperature sensor 96 during the predetermined period).

The controller 70 executes the defrost operation in the first defrost control mode when the air temperature Toa is determined as being equal to or more than the second determination temperature Tat in step S11 (step S12). In other words, when the air temperature Toa is determined as being equal to or more than the second determination temperature Tat, the controller 70 determines termination of the defrost operation based on the first refrigerant temperature T1 measured by the first temperature sensor 92*c*.

The controller 70 executes the defrost operation in the second defrost control mode when the air temperature Toa is determined as being less than the second determination temperature Tat in step S11 (step S13). In other words, when the air temperature Toa is determined as being less than the second determination temperature Tat, the controller 70 determines termination of the defrost operation based on the second refrigerant temperature T2 measured by the second temperature sensor 92*d*.

The air temperature around the heat source heat exchanger 20 being relatively high indicates that the temperature of the refrigerant flowing in the sub heat exchange unit 28 is less likely to be low. In a case where the refrigerant flowing in the sub heat exchange unit 28 has relatively high temperature, the sub heat exchange unit 28 is less likely to have problematic frost. In another case where the refrigerant flowing in the sub heat exchange unit 28 has relatively low temperature, the sub heat exchange unit 28 possibly has problematic frost.

The present refrigerant cycle apparatus 100 executes the defrost operation in the first defrost control mode when the air temperature Toa around the heat source heat exchanger 20 is relatively high. This configuration is thus likely to suppress unnecessary extension of the defrost time.

The present refrigerant cycle apparatus 100 executes the defrost operation in the second defrost control mode when the air temperature Toa around the heat source heat exchanger 20 is relatively low. This configuration is likely to suppress frost from remaining unmelted at the heat source heat exchanger 20 even when the air temperature Toa is relatively low.

(5-2) Modification Example B

The refrigerant cycle apparatus 100 according to the above embodiment is configured to inject a gas refrigerant into the compression space during compression in the compression mechanism of the compressor 12. However, the refrigerant cycle apparatus may alternatively not be configured to inject the gas refrigerant.

(5-3) Modification Example C

The refrigerant cycle apparatus 100 according to the above embodiment is configured to switch between the cooling operation and the heating operation. However, the present disclosure should not be limited to this case. For example, the refrigerant cycle apparatus 100 may alternatively be configured to execute only the heating operation and the defrost operation.

(5-4) Modification Example D

The refrigerant cycle apparatus 100 according to the above embodiment includes the distributor 25 as the pressure loss portion of the heat source heat exchanger 20. However, the pressure loss portion should not be limited to the distributor.

The pressure loss portion is a portion that possibly has a larger pressure drop in comparison to an upstream portion when a refrigerant flows to a condenser as described above. The configuration according to the above embodiment is effective also in a case where the condenser includes a pressure loss portion other than the distributor (e.g. a branching portion of the refrigerant flow paths, a curved portion of a refrigerant flow path, an expanding portion (including a rapidly expanding portion or a diffuser) of a refrigerant flow path, and a reducing portion (including a rapidly reducing portion or a nozzle) of a refrigerant flow path.

The embodiment and the modification examples of the present disclosure have been described above. Various modifications to modes and details will be available without departing from the object and the scope of the present disclosure recited in the claims.

INDUSTRIAL APPLICABILITY

The present disclosure is useful and widely applicable to a refrigerant cycle apparatus including a heat exchange unit having a main heat exchange unit, a sub heat exchange unit, and a pressure loss portion disposed between the main heat exchange unit and the sub heat exchange unit, and configured to execute defrost operation of defrosting the heat exchange unit and causing a refrigerant to flow in a direction opposite to a direction during normal operation.

REFERENCE SIGNS LIST

12 compressor
14 flow direction switching mechanism
18 expansion mechanism
20 heat source heat exchanger (first heat exchange unit)

22 main heat exchange unit
25 distributor (pressure loss portion)
28 sub heat exchange unit
62 utilization heat exchanger (second heat exchange unit)
70 controller (operation control unit)
80 refrigerant circuit
92*c* first temperature sensor (first refrigerant temperature measurement unit)
92*d* second temperature sensor (second refrigerant temperature measurement unit)
96 air temperature measurement unit
100 refrigerant cycle apparatus
T1 first refrigerant temperature
T2 second refrigerant temperature
Tat second determination temperature (second temperature)
Toa air temperature
Trt first determination temperature (first temperature)

CITATION LIST

Patent Literature

Patent Literature 1: JP S63-201442 A

The invention claimed is:

1. A refrigerant cycle apparatus comprising:

a refrigerant circuit including a compressor configured to compress a refrigerant, a first heat exchange unit having a main heat exchange unit, a sub heat exchange unit, and a pressure loss portion disposed on a flow path of the refrigerant between the main heat exchange unit and the sub heat exchange unit, a second heat exchange unit, an expansion mechanism disposed on the flow path of the refrigerant between the first heat exchange unit and the second heat exchange unit and configured to decompress the refrigerant, and a flow direction switching mechanism configured to switch a flow direction of the refrigerant discharged from the compressor, between a first flow direction of the refrigerant flowing in an order of the second heat exchange unit, the expansion mechanism, the sub heat exchange unit, the pressure loss portion, and the main heat exchange unit, and a second flow direction of the refrigerant flowing in a direction opposite to the first flow direction;

a first refrigerant temperature sensor configured to measure, as a first refrigerant temperature, the temperature of the refrigerant flowing in the main heat exchange unit or between the main heat exchange unit and the pressure loss portion;

a second refrigerant temperature sensor configured to measure, as a second refrigerant temperature, the temperature of the refrigerant flowing between the pressure loss portion and the expansion mechanism; and an operation controller configured to control the flow direction switching mechanism to switch between normal operation of causing the refrigerant to flow in the first flow direction and defrost operation of causing the refrigerant to flow in the second flow direction, wherein the operation controller has control modes for the defrost operation, including at least a first defrost control mode of terminating the defrost operation based on the first refrigerant temperature and a second defrost control mode of terminating the defrost operation based on the second refrigerant temperature, wherein the operation controller executes the defrost operation in the first defrost control mode when the second refrigerant temperature measured before the defrost operation starts is equal to or more than first temperature.

2. The refrigerant cycle apparatus according to claim 1, wherein the operation controller executes the defrost operation in the first defrost control mode when the second refrigerant temperature measured during the normal operation before the defrost operation starts is equal to or more than the first temperature.

3. The refrigerant cycle apparatus according to claim 1, wherein the operation controller executes the defrost operation in the second defrost control mode when the measured second refrigerant temperature measured is less than the first temperature.

4. A refrigerant cycle apparatus comprising:

a refrigerant circuit including a compressor configured to compress a refrigerant, a first heat exchange unit having a main heat exchange unit, a sub heat exchange unit, and a pressure loss portion disposed on a flow path of the refrigerant between the main heat exchange unit and the sub heat exchange unit, a second heat exchange unit, an expansion mechanism disposed on the flow path of the refrigerant between the first heat exchange unit and the second heat exchange unit and configured to decompress the refrigerant, and a flow direction switching mechanism configured to switch a flow direction of the refrigerant discharged from the compressor, between a first flow direction of the refrigerant flowing in an order of the second heat exchange unit, the expansion mechanism, the sub heat exchange unit, the pressure loss portion, and the main heat exchange unit, and a second flow direction of the refrigerant flowing in a direction opposite to the first flow direction;

a first refrigerant temperature sensor configured to measure, as a first refrigerant temperature, the temperature of the refrigerant flowing in the main heat exchange unit or between the main heat exchange unit and the pressure loss portion;

a second refrigerant temperature sensor configured to measure, as a second refrigerant temperature, the temperature of the refrigerant flowing between the pressure loss portion and the expansion mechanism; p1 an operation controller configured to control the flow direction switching mechanism to switch between normal operation of causing the refrigerant to flow in the first flow direction and defrost operation of causing the refrigerant to flow in the second flow direction; and an air temperature sensor configured to measure air temperature around the first heat exchange unit, wherein the operation controller has control modes for the defrost operation, including at least a first defrost control mode of terminating the defrost operation based on the first refrigerant temperature and a second defrost control mode of terminating the defrost operation based on the second refrigerant temperature, and the operation controller executes the defrost operation in the first defrost control mode when the air temperature is equal to or more than the second temperature.

5. The refrigerant cycle apparatus according to claim 4, wherein the operation controller executes the defrost operation in the second defrost control mode when the air temperature is less than the second temperature.

6. The refrigerant cycle apparatus according to claim 1, wherein the pressure loss portion is a branching portion of a refrigerant flow path in the first flow direction.

7. The refrigerant cycle apparatus according to claim 2, wherein the operation controller unit executes the defrost operation in the second defrost control mode when the measured second refrigerant temperature measured is less than the first temperature.

8. The refrigerant cycle apparatus according to claim 4, wherein the pressure loss portion is a branching portion of a refrigerant flow path in the first flow direction.

* * * * *